US006604396B2

(12) United States Patent
Kobayashi

(10) Patent No.: US 6,604,396 B2
(45) Date of Patent: Aug. 12, 2003

(54) WIRE CONDENSER ELEMENT BENDING METHOD AND WIRE CONDENSER ELEMENT BENDING APPARATUS

(75) Inventor: Norio Kobayashi, Koga (JP)

(73) Assignee: Sanoh Kogyo Kabushiki Kaisha, Koga (JP)

( * ) Notice: Subject to any disclaimer, the term of this patent is extended or adjusted under 35 U.S.C. 154(b) by 0 days.

(21) Appl. No.: 10/038,693

(22) Filed: Jan. 2, 2002

(65) Prior Publication Data

US 2002/0059964 A1 May 23, 2002

(51) Int. Cl.[7] ..... B21C 47/00

(52) U.S. Cl. ..... 72/147; 72/146; 72/148; 29/890.03

(58) Field of Search ..... 72/133, 146, 147, 72/148, 169; 29/890.03; 140/71 R

(56) References Cited

U.S. PATENT DOCUMENTS 3,519,902 A * 7/1970 Morozovsky ..... 361/272
4,212,179 A * 7/1980 Juergens ..... 29/623.1
4,346,577 A * 8/1982 Peters et al. ..... 29/890.126
5,700,299 A * 12/1997 Clark ..... 156/446

* cited by examiner

*Primary Examiner*—Lowell A. Larson
*Assistant Examiner*—John S. Goetz
(74) *Attorney, Agent, or Firm*—Ladas & Parry

(57) ABSTRACT

A wire condenser element bending method and a wire condenser element bending apparatus bend two wire condenser elements by pressing the wire condenser elements against a bending roller to form two scroll wire condensers simultaneously. Inner edge parts of the wire condenser elements are held by holding devices at diametrically opposite positions on the outer circumference of the bending roller. Pressure rollers press the two wire condenser elements against the bending roller while the bending roller is rotated to form two scroll wire condensers simultaneously. Each wire condenser element serves as a separator for separating layers of the other wire condenser element.

17 Claims, 5 Drawing Sheets

WIRE CONDENSER ELEMENT BENDING METHOD AND WIRE CONDENSER ELEMENT BENDING APPARATUS

BACKGROUND OF THE INVENTION

1. Field of the Invention

The present invention relates to a wire condenser element bending method of forming a scroll wire condenser for an air conditioning system or the like by scrolling a wire condenser element, and a wire condenser element bending apparatus for carrying out the wire condenser element bending method.

2. Description of the Related Art

A wire condenser element of this type having a large heat-transfer area is formed by bending a thin-wall, small-diameter metal tube of a metal having a high thermal conductivity and good workability, such as copper, in a plurality of parallel segments, and extending iron wires across the plurality of segments of the metal tube to increase heat radiating rate and to reinforce the wire condenser element.

FIG. 5(*a*) shows a general wire condenser element 2 formed by bending a metal tube 3 in a plurality of segments and extending iron wires 4 across the plurality of segments of the metal tube 3, and FIG. 5(*b*) shows a scroll wire condenser 1 formed by processing the wire condenser element 2. Various wire condensers as a component of a condenser unit are available. The wire condenser 1 shown in FIG. 5(*b*) is formed by scrolling the wire condenser element 2 shown in FIG. 5(*a*). Wire condensers similar to the wire condenser 1 shown in FIG. 5(*b*) has compact construction and a large heat-transfer and hence such wire condensers are used prevalently.

A conventional scroll wire condenser forming process illustrated in FIGS. 6(*a*) and 6(*b*) scrolls the wire condenser element 2 by using a roller to form the scroll wire condenser 1. As shown in FIG. 6(*a*), the wire condenser element 2 is fed longitudinally. The wire condenser element 2 is pressed against a rotating bending roller 5 by a rotating pressure roller 6 to roll the wire condenser element 2 around the bending roller 5. The innermost layer of the wire condenser element 2 is wound around the bending roller 5 and hence any particular problem does not arise. When winding the second innermost layer and other outer layers, a separator 7, i.e., a sheet, must be bent and wound together with the wire condenser element 2 around the bending roller 5 to secure a clearance between the layers of the wire condenser element 2 as shown in FIG. 6(*b*). After thus winding the wire condenser element 2 together with the separator 7 in a scroll as shown in FIG. 6(*b*), the separator 7 is removed from the scroll to complete the wire condenser 1.

Thus, the separator 7 is indispensable to the conventional scroll wire condenser forming process to secure a clearance between the adjacent layers of the wire condenser element 2. Generally, the separator 7 is a flexible sheet, such as a corrugated cardboard or a rubber sheet. The separator 7 is used repeatedly and hence must have strength high enough to withstand repetitive use. However, corrugated board and the rubber sheet are unsatisfactory in durability and are damaged and broken in a short service time. Although separators of various materials have been tested and proposed, any optimum separators satisfactory in durability have not been available up to the present.

Work for removing the separator from the scroll wire condenser is not suitable for automation and the separator is removed by manual work, which is an impediment to the improvement of manufacturing efficiency.

SUMMARY OF THE INVENTION

Accordingly, it is an object of the present invention to solve problems in the conventional techniques and to provide a wire condenser element bending method not requiring any separator and capable of forming a scroll wire condenser at a high productivity.

Another object of the present invention is to provide a wire condenser element bending apparatus for carrying the wire condenser element bending method.

The present invention provides a bending method of bending wire condenser elements each formed by bending a small-diameter metal tube in a plurality of parallel segments and extending metal wires across the segments of the metal tube around a bending roller to form scroll wire condensers, comprising the steps of: holding inner edge parts of two or more wire condenser elements respectively by holding devices arranged at equal angular intervals on an outer circumference of the bending roller; winding the two or more wire condenser elements around the bending roller by pressing the wire condenser elements against the bending roller with pressure rollers while the bending roller is rotated so that respective layers of the wire condenser elements are superposed sequentially to form two or more scroll wire condensers, using each wire condenser element as a separator for separating layers of the adjacent other wire condenser element or elements.

Thus, the layers of the wire condenser elements serve as separators for separating the layers of adjacent other wire condenser elements.

The present invention provides a wire condenser element bending apparatus for bending a plurality of wire condenser elements each formed by bending a small-diameter metal tube in a plurality of parallel segments and extending metal wires across the segments of the metal tube around a bending roller to form a plurality of scroll wire condensers, said bending apparatus comprising: a bending roller provided with holding devices arranged at equal angular intervals on its outer circumference to hold inner edge parts of the plurality of wire condenser elements detachably on the outer circumference of the bending roller; a driving unit for driving the bending roller for rotation; and pressing mechanisms including pressure rollers for pressing the wire condenser elements against the bending roller.

According to the present invention, the layers of the plurality of wire condenser elements serve as separators for separating the adjacent layers of the other wire condenser elements. Thus, the present invention does not need any separator and is capable of simultaneously forming a plurality of scroll wire condensers.

BRIEF DESCRIPTION OF THE DRAWINGS

The above and other objects features and advantages of the present invention will become more apparent from the following description taken in connection with the accompanying drawings, in which.

DESCRIPTION OF THE PREFERRED EMBODIMENTS

Figure 1:
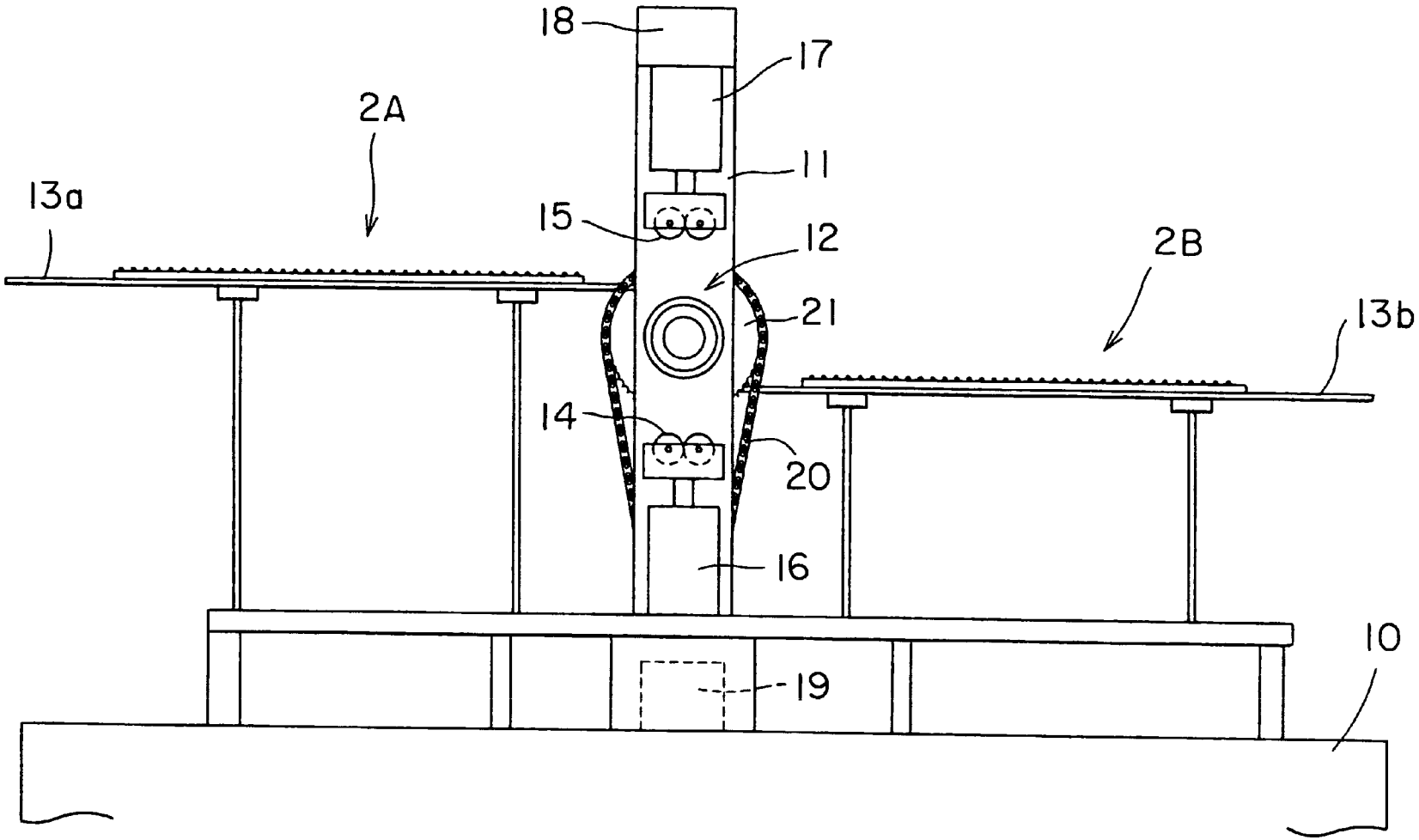
FIG. 1 is a schematic side elevation of a wire condenser element bending apparatus in a preferred embodiment according to the present invention for carrying out a wire condenser element bending method according to the present invention.
Figure 4A:
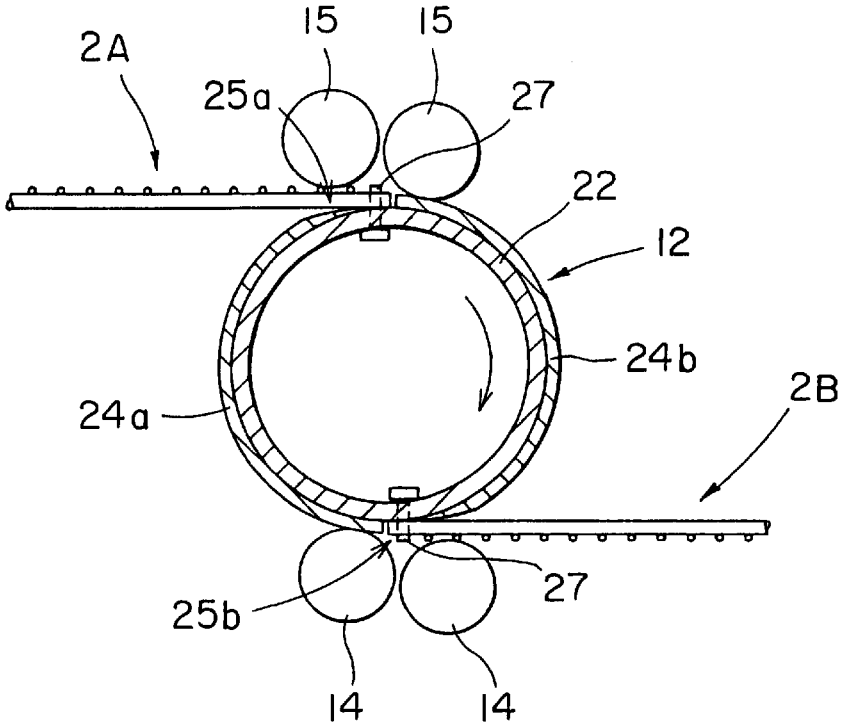
FIGS. 4(*a*) and 4(*b*) are sectional views of assistance in explaining the wire condenser element bending method according to the present invention.
Figure 4B:
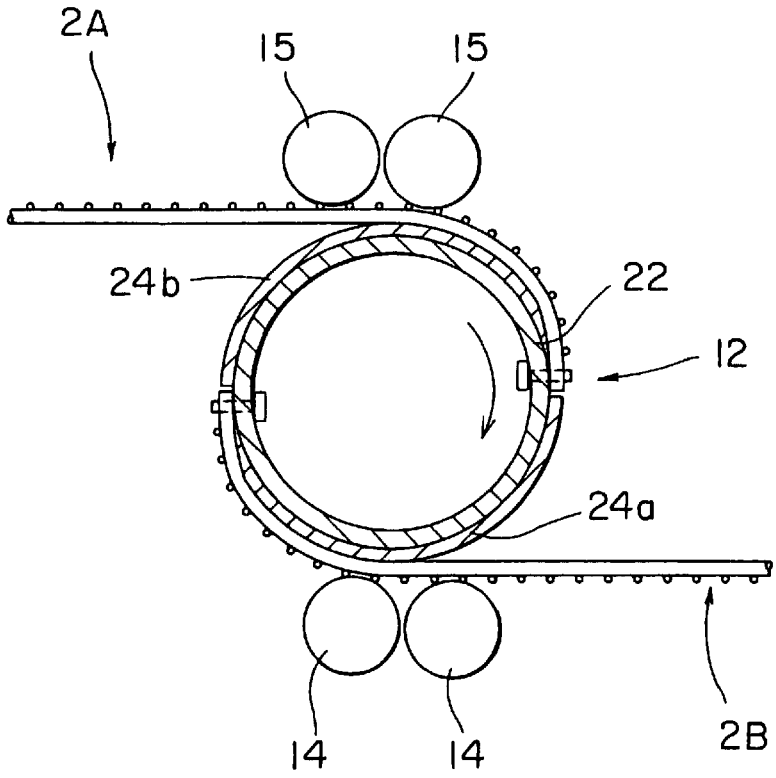
Figure 5A:
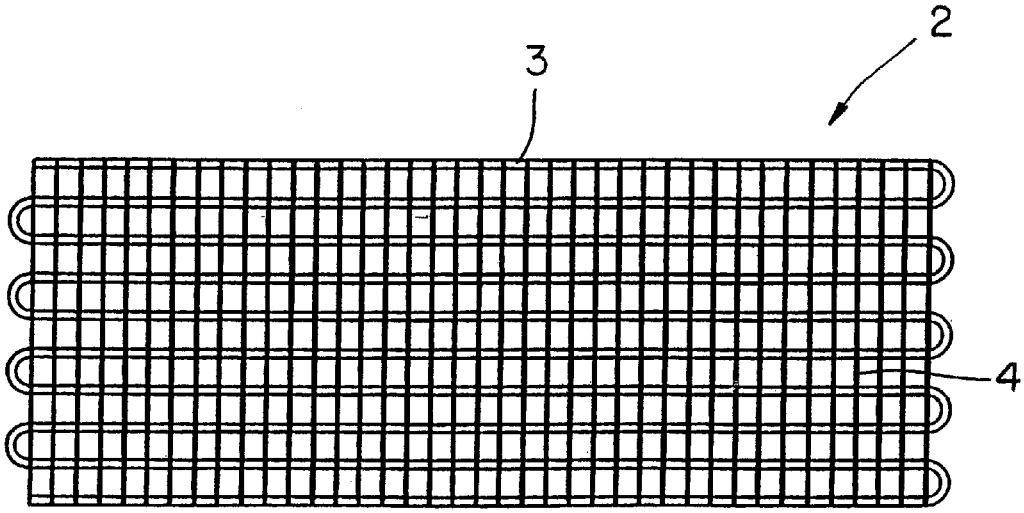
FIG. 5(a) PRIOR ART
FIGS. 5(*a*) and 5(*b*) are a plan view of a wire condenser element and a perspective view of a scroll wire condenser, respectively.
Figure 5B:
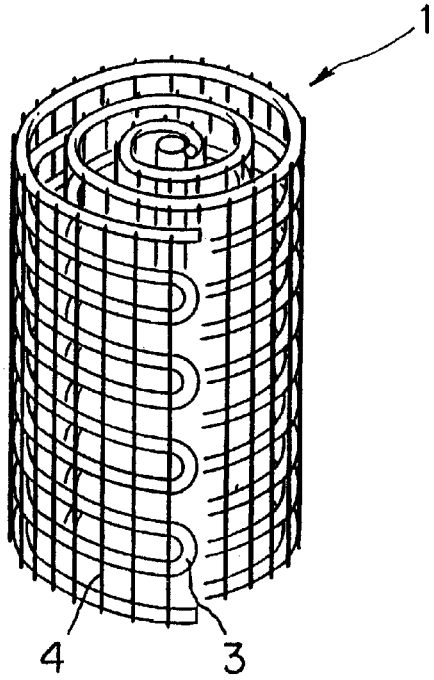
FIG. 5(b) PRIOR ART
Figure 6A:
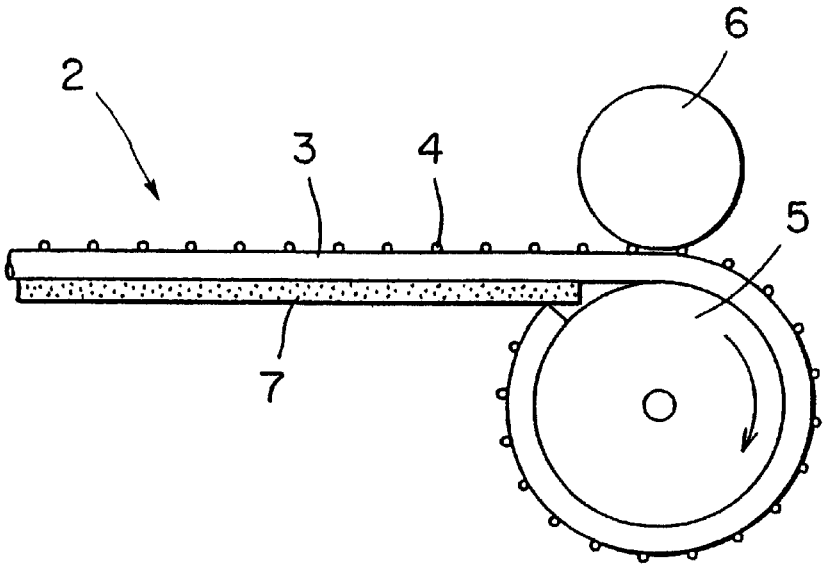
FIG. 6(a) PRIOR ART
FIGS. 6(*a*) and 6(*b*) are views of assistance in explaining a conventional scroll wire condenser forming process.
Figure 6B:
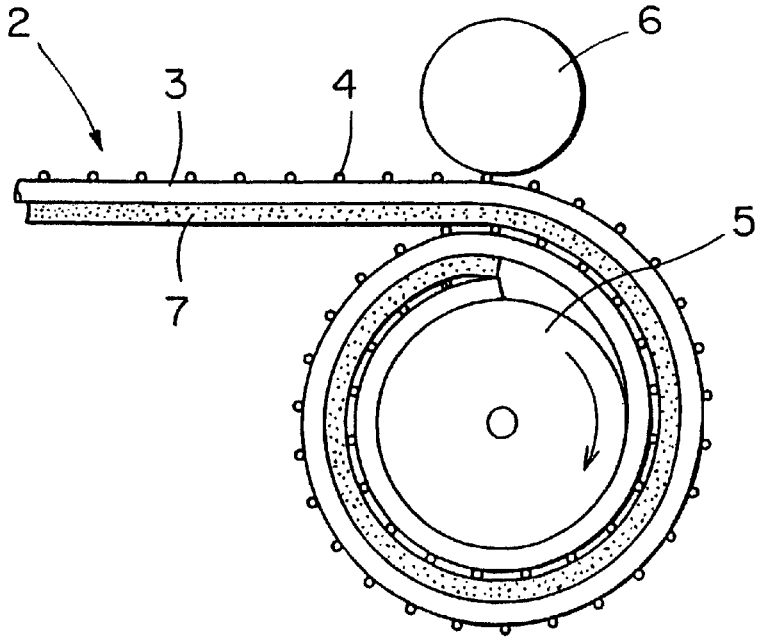
FIG. 6(b) PRIOR ART

FIG. 1 shows a wire condenser element bending apparatus in a preferred embodiment according to the present invention capable of simultaneously scrolling two wire condenser elements 2A and 28 as shown in FIGS. 4(*a*) and 4(*b*). Referring to FIG. 1, a column 11 is set upright on a base 10, and a bending roller 12 is supported with its axis horizontally extended on the column 11. Work feed tables 13*a* and 13*b* respectively for supporting the wire condenser elements 2A and 2B thereon are disposed on the left and the right side, as viewed in FIG. 1, of the bending roller 12 at different levels, respectively. The difference in height between the upper surfaces of the work feed tables 13*a* and 13*b* is, for example, substantially equal to the diameter of the bending roller 12. Lower pressure rollers 14 are disposed directly below the bending roller 12, and upper pressure rollers 15 are disposed directly above the bending roller 12. The pressure rollers 14 and 15 are driven for vertical movement by pneumatic cylinder actuators 16 and 17, respectively. The pneumatic cylinder actuator 17 is held on a horizontal crossbeam 18 joined to an upper part of the column 11. The lower pressure rollers 14 and the lower pneumatic cylinder actuator 16, and the upper pressure rollers 15 and the upper pneumatic cylinder actuator 17 form lower and upper pressing mechanism, respectively. The wire condenser element 2A is fed from left to right on the work feed table 13*a* substantially tangentially to the bending roller 12. The wire condenser element 28 is fed from right to left on the work feed table 13*b* substantially tangentially to the bending roller 12. A motor 19 is mounted on the base 10 to drive the bending roller 12 for rotation. The rotation of the output shaft of the motor 19 is transmitted through a chain 20 and a sprocket 21 at a reduced rotating speed to the bending roller 12.

Figure 2:
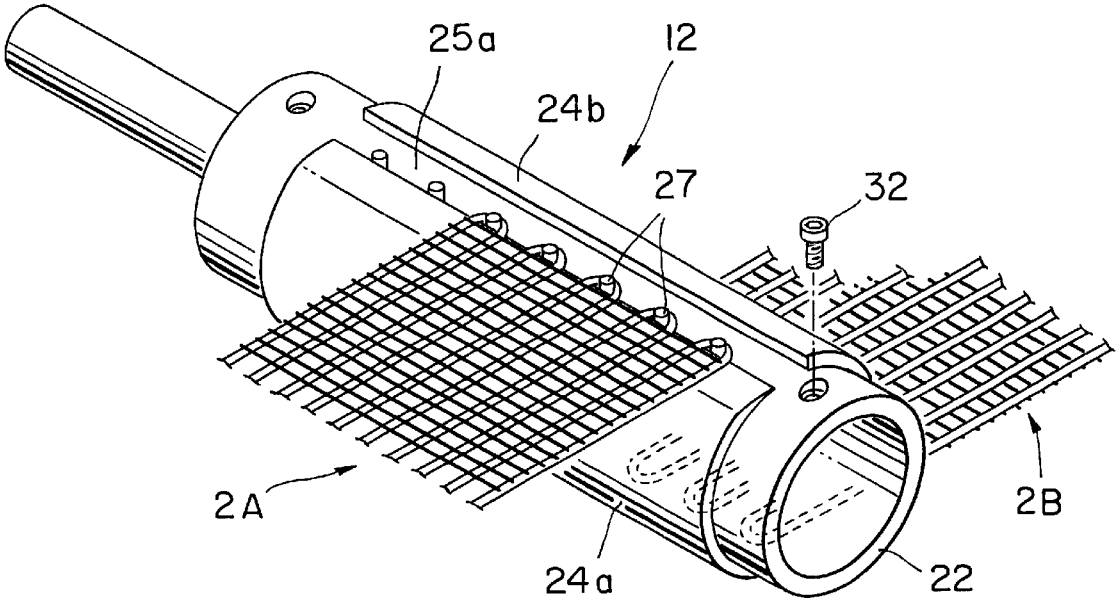
FIG. 2 is a perspective view of a bending roller included in the wire condenser element bending apparatus shown in FIG. 1.
Figure 3:
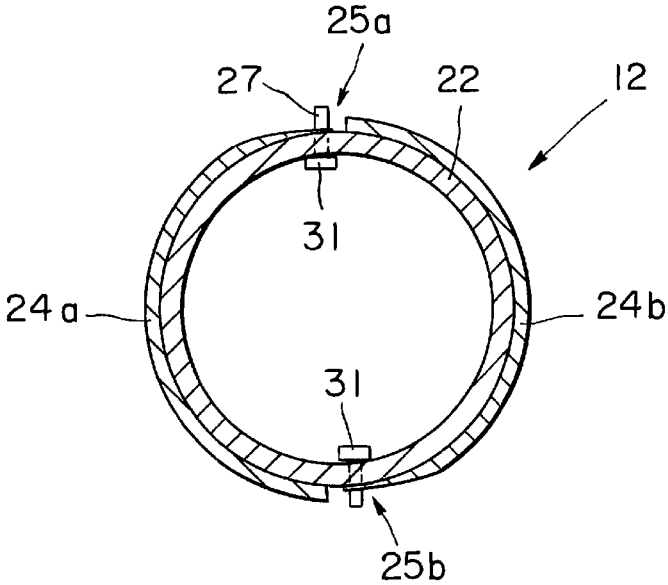
FIG. 3 is a cross-sectional view of the bending roller shown in FIG. 2.

Referring to FIGS. 2 and 3, the bending roller 12 has a cylindrical body 22, and semicylindrical members 24*a* and 24*b*. The semicylindrical members 24*a* and 24*b* are attached to the circumference of the cylindrical body 22 so as to define straight grooves 25*a* and 25*b* parallel to the axis of the bending roller 12 between the edges thereof. The straight grooves 25*a* and 25*b* are formed diametrically opposite to each other with respect to the axis of the bending roller 12. A plurality of holding pins 27 are arranged at predetermined intervals in parallel to the axis of the bending roller 12 in the straight grooves 25*a* and 25*b*. The holding pins 27 are set in pin-holding bars 31. The pin-holding bars 31 are attached detachably to the inner circumference of the bending roller 12. Each of the pin-holding bars 31 is fastened to the inner circumference of the bending roller 12 with two bolts 32. The two pin-holding bars 31 are used to hold inner edge parts of the wire condenser elements 2A and 2B on the bending roller 12. The bolts 32 are unfastened to remove the pin-holding bars 32 holding the holding pins 27 from the bending roller 12. The holding pins 27 are engaged in U-shaped bends in the metal tubes forming the wire condenser elements 2A and 2B to hold the inner edge parts of the wire condenser elements 2A and 2B detachably on the bending roller 12.

A wire condenser element bending method to be carried out by the wire condenser element bending apparatus thus constructed will be described hereinafter. Referring to FIGS. 4(*a*) and 4(*b*), the wire condenser elements 2A and 2B are placed on the work feed tables 13*a* and 13B, respectively. The bending roller 12 is held with the straight groove 25*a*, in which the inner edge part of the wire condenser element 2A is placed, located at a top position and the straight groove 25*b* in which the inner edge part of the wire condenser element 2B is placed located at a bottom position as shown in FIG. 4(*a*). Then, the U-shaped bends in the metal tubes of the wire condenser elements 2A and 2B are put on the holding pins 27 as shown in FIG. 2 to hold the inner edge parts of the wire condenser elements 2A and 2B at the diametrically opposite positions on the bending roller 12.

Then, the pneumatic cylinder actuators 16 and 17 are actuated to press the wire condenser elements 2B and 2A against the bending roller 12 with the lower pressure rollers 14 and the upper pressure rollers 15, respectively. The pressure rollers 14 and 15 are thus kept pressed against the wire condenser elements 2B and 2A by the pneumatic cylinder actuators 16 and 17, respectively. Then, the motor 19 is actuated to rotate the bending roller 12 slowly to wind the wire condenser elements 2A and 2B around the bending roller 12. During the initial rotation of the bending roller 12 through an angle of 180°, the wire condenser elements 2A and 2B are bent so as to conform to the outer surfaces of the semicylindrical members 24*a* and 24*b*, respectively. After the bending roller 12 has been turned through an angle of 180°, the wire condenser element 2A is wound on layers of the wire condenser element 2B, and the wire condenser element 2B is wound on layers of the wire condenser element 2A. Thus, the layers of the wire condenser element 2A serve as a separator for a scroll wire condenser formed by rolling the wire condenser element 2B, and those of the wire condenser element 2B serve as a separator for a scroll wire condenser formed by rolling the wire condenser element 2A. Thus, two scroll wire condensers are formed simultaneously by simultaneously winding the wire condenser elements 2A and 2B.

After the scroll wire condensers have been formed by winding the wire condenser elements 2A and 2B around the bending roller 12, the pneumatic cylinder actuators 16 and 17 are operated to separate the presser rollers 14 and 15 from the wire condenser elements 2B and 2A. Then, the bolts 32 are unfastened and the pin-holding bars 31 holding the holding pins 27 are removed from the bending roller 12. Then the scroll wire condensers are removed from the bending roller 12 and are separated. Since the wire condenser elements 2A and 2B are flexible, the scroll wire condensers can be easily separated.

Although the invention has been described as applied to the wire condenser element bending apparatus capable of simultaneously forming two scroll wire condensers, the present invention is applicable to a wire condenser element bending apparatus capable of simultaneously forming three or more scroll wire condensers. When the present invention is applied to a wire condenser element bending apparatus capable of simultaneously forming three scroll wire condensers, three straight grooves parallel to the axis of the bending roller 12 are formed on the outer circumference of the bending roller at angular intervals of 120°, inner edge parts of three wire condenser elements are held detachably by holding members disposed in the three straight grooves, and the three wire condenser elements are bent with three sets of pressure rollers to wind the three wire condenser elements around the bending roller 12.

The bending roller 12 may be a tubular roller, a solid roller or a polygonal roller.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A method of bending wire condenser elements around a bending roller to form scroll wire condensers, each wire condenser element being formed by bending a small-diameter metal tube in a plurality of parallel segments and connecting metal wires across the segments of the metal tube, each scroll wire condenser being individually usable and formed from a respective wire condenser element, said bending method comprising the steps of:

holding inner edge parts of two or more wire condenser elements respectively by holding devices arranged at equal angular intervals on an outer circumference of the bending roller;

winding the two or more wire condenser elements around the bending roller by pressing the wire condenser elements against the bending roller with pressure rollers while the bending roller is rotated so that respective layers of the wire condenser elements are superposed sequentially to form two or more scroll wire condensers, in which each wire condenser element serves as a separator for separating layers of the adjacent other wire condenser element or elements;

removing the scroll wire condensers, formed by scrolling the two or more wire condenser elements, from the bending roller; and separating the two or more scroll wire condensers into individual scroll wire condensers.

2. The wire condenser element bending method according to claim 1, further comprising the step of:

removing the scroll wire condensers formed by scrolling the two or more wire condenser elements from the bending roller; and separating the two or more scroll wire condensers into individual scroll wire condensers.

3. The wire condenser element bending method according to claim 1, wherein each of the holding devices includes a pin-holding bar detachably attached to an inner circumference of the bending roller so as to extend in parallel to an axis of the bending roller, and a plurality of pins are set on the pin-holding bar so as to project from an outer circumference of the bending roller; and the plurality of pins are engaged in U-shaped bends in the metal tube forming each wire condenser element to hold the inner edge part of the wire condenser element detachably on the bending roller.

4. The wire condenser element bending method according to claim 3 further comprising the step of removing the holding devices from the bending roller after completion of the step of bending the wire condenser elements.

5. A wire condenser element bending apparatus for bending a plurality of wire condenser elements around a bending roller to form a plurality of scroll wire condensers, each wire condenser element being formed by bending a small-diameter metal tube in a plurality of parallel segments and connecting metal wires across the segments of the metal tube, each scroll wire condenser being individually usable and formed from a respective wire condenser element, said bending apparatus comprising:

a bending roller provided with holding devices arranged at equal angular intervals on its outer circumference to hold inner edge parts of the plurality of wire condenser elements detachably on the outer circumference of the bending roller;

a driving unit for driving the roller in rotation; and pressing mechanism including pressure rollers for pressing the wire condenser elements against the bending roller to form two or more scroll wire condensers, in which each wire condenser element serves as a separator for separating layers of the adjacent other wire condenser element or elements and each of said two or more scroll wire condensers is individually separable as a finished product from each layer.

6. The wire condenser element bending apparatus according to claim 5, wherein the bending roller is provided in its outer circumference with straight grooves extending in parallel to the axis of the bending roller to place the inner edge parts of the wire condenser elements therein.

7. The wire condenser element bending apparatus according to claim 6, wherein the holding devices are placed in the straight grooves, respectively.

8. The wire condenser element bending apparatus according to claim 5, wherein each holding device includes a pin-holding bar capable of being detachably fastened to an inner circumference of the bending roller in parallel to the axis of the bending roller, and a plurality of holding pins set on the pin-holding bar so as to project from the outer circumference of the bending roller when the pin-holding bar is fastened to the inner circumference of the bending roller.

9. The wire condenser element bending apparatus according to claim 8, wherein the plurality of pins are engaged in U-shaped bends in the metal tube of each wire condenser element to hold the inner edge part of the wire condenser element detachably on the bending roller.

10. The wire condenser element bending apparatus according to claim 5, wherein the wire condenser elements are two in number.

11. The wire condenser element bending apparatus according to claim 10, wherein two straight grooves extending in parallel to an axis of the bending roller are provided to place the inner edge parts of the wire condenser elements therein, and the two straight grooves are disposed diametrically opposite to each other.

12. The wire condenser element bending apparatus according to claim 10, wherein the bending roller is supported with its axis extended horizontally, and two work feed tables for supporting the two wire condenser elements are disposed with their support surfaces extended at different levels, respectively.

13. The wire condenser element bending apparatus according to claim 12, wherein a difference in height between upper surfaces of the work feed tables is substantially equal to a diameter of the bending roller.

14. The wire condenser element bending apparatus according to claim 12, wherein the two work feed tables are disposed on opposite sides of the bending roller, respectively.

15. A method of bending wire condenser elements which are in a flat form and each comprises a small diameter metal tube bent successively in opposite directions to form parallel longitudinal segments connected at opposite ends by reverse U-shaped bends and crosswise wires connected to said parallel, longitudinal segments, said method comprising, holding one of the ends of a plurality of the wire condenser elements at equal angular intervals on an outer surface of a bending roller, applying pressure on each wire condenser element to press the wire condenser elements against he bending roller, rotating the roller to wind the wire condenser elements around the roller to form scroll condensers wherein the wire condenser elements are wound one adjacent another so that each wire condenser element serves as an intermediate spacer for an adjacent wire condenser element, removing the now bent wire condenser elements formed as scroll condensers from the roller, and separating the bent wire condenser elements from one another as respective scroll condensers.

16. The method of claim 15, wherein the ends of the plurality of the wire condenser elements are held on the bending roller by releasably engaging the U-shaped bends at the ends of the plurality of wire condenser elements.

17. The method of claim 16, wherein the U-shaped ends of the tire condenser elements are releasably held by inserting pins into said U-shaped bends.

* * * * *